US005394769A

United States Patent [19]

Cropley

[11] Patent Number: 5,394,769

[45] Date of Patent: Mar. 7, 1995

[54] HANDLE

[75] Inventor: Geoffrey D. Cropley, Wetherill Park, Australia

[73] Assignee: Titan Australia Pty Limited, Wetherill Park, Australia

[21] Appl. No.: 155,707

[22] Filed: Nov. 22, 1993

[30] Foreign Application Priority Data

Feb. 25, 1993 [AU] Australia ..... PL7507

[51] Int. Cl.[6] ..... G05G 1/00

[52] U.S. Cl. ..... 74/545; 74/557; D8/309

[58] Field of Search ..... 74/545, 557, 543, 544, 74/546, 547, 548; D8/309, 359; D19/74

[56] References Cited

U.S. PATENT DOCUMENTS

| | | | |
|---|---|---|---|
| D. 292,550 | 11/1987 | Jackson | 74/545 X |
| D. 305,544 | 1/1990 | Ganter | D8/309 |
| D. 328,173 | 7/1992 | Nelson | D8/359 X |
| D. 336,233 | 6/1993 | Zimmermann | D8/309 |
| 2,290,815 | 7/1942 | Ruppel | 74/545 |
| 2,336,082 | 12/1943 | Floraday | 74/545 |
| 3,988,946 | 11/1976 | Gonzalez | D8/309 X |
| 4,338,827 | 7/1982 | Hooker | 74/557 X |
| 4,534,240 | 8/1985 | Dietz et al. | 74/545 |

FOREIGN PATENT DOCUMENTS

| | | | |
|---|---|---|---|
| 1190262 | 4/1965 | Germany | 74/545 |
| 2216823 | 10/1973 | Germany | 74/545 |
| 3238739 | 4/1984 | Germany | 74/545 |
| 450892 | 7/1936 | United Kingdom | 74/545 |
| 92/00256 | 12/1992 | WIPO | 74/545 |

*Primary Examiner*—Vinh T. Luong
*Attorney, Agent, or Firm*—Abelman, Frayne & Schwab

[57] ABSTRACT

A handle is provided which includes an elongate recessed body portion of a substantially open-faced "U" configuration when viewed in transverse cross-section, and an elongate cover portion of a substantially open-faced inverted "U" configuration when viewed in transverse cross-section, and reinforcements are provided within both the body portion and the cover portion, the outer sides thereof having been formed and profiled, so as to allow for substantial open-face to open-face engagement therebetween, and the body portion and cover portion having been sealably engaged one to the other, so as to form an integral, reinforced handle.

9 Claims, 3 Drawing Sheets

HANDLE

BACKGROUND TO THE PRESENT INVENTION

This invention relates to a handle and in particular to a winch handle which has improved features of strength and rigidity. In a preferred form of the invention the winch handle is a winch handle formed substantially of a plastics material which is used as a marine winch handle. It is however envisaged that the winch handle of the present invention can have other uses, such as being used as a handle for other forms of devices.

In our international patent application No PCT/AU92/00256, we disclose a buoyant handle which includes an elongate recessed body portion of a substantially open faced "U" configuration when viewed in transverse cross-section. A spigot is provided adjacent one end of the handle to allow the handle to be releasably engaged with a winch and a hand grip is provided at the other end. Reinforcing webs and transverse dividing walls are provided within the recessed body portion to strengthen the body portion. Further, a flat cover is provided and this sealably engages with and over the open face of the body portion, so as to form a reinforced flotation/buoyancy chamber. The invention of our international patent specification No PCT/AU92/00256 overcomes problems which have been commonly associated with winch handles previously used, especially with marine craft, such as boats, sailing craft, yachts and the like. In using previously known winch handles, there has always been a problem that such winch handles have often fallen over board, or been knocked over the side of a marine craft, to thus sink to the bottom. Such winch handles are often particularly expensive both to manufacture and purchase. Thus, the loss of winch handles "overboard" from marine craft involves not only inconvenience and a risk to safety, but also substantial expense. The winch handle disclosed in our international patent application No PCT/AU92/00256 goes at least some way towards overcoming or minimising these problems by providing an essentially flotable winch handle.

The present invention sets out to provide a further form of winch handle which, while in a preferred form of the invention, is floatable, need not necessarily be so. However, the winch handle of the present invention sets out to provide a winch handle with superior inherent features of strength and rigidity.

The winch handle of our international patent application No PCT/AU92/00256 is particularly effective in use and is floatable. Further, it has inherent features of strength, given that winch handles (and in particular winch handles used on marine craft) are subject to substantial stresses, strains and torque. However, the winch handle of the present invention sets out to provide features of even greater strength to further enhance the features of strength and rigidity in so far as the winch handle is concerned.

Other objects of the present invention will become apparent from the following description.

SUMMARY OF THE PRESENT INVENTION

According to one aspect of this invention there is provided a winch handle including an elongate recessed body portion of a substantially open-faced "U" configuration when viewed in transverse cross-section; reinforcing means being provided within said body portion; an elongate recessed cover portion being provided and being of a substantially open-faced inverted "U" configuration when viewed in transverse cross-Section; reinforcing being provided within said cover portion; said body portion and said cover portion being so formed and adapted as to engage one with the other substantially open-face to open-face, and said body portion and cover portion being sealably engaged one with the other, to form an elongate reinforced shaft for said winch handle.

According to a further aspect of this invention there is provided a winch handle including an elongate recessed body portion of a substantially open-faced "U" configuration when viewed in transverse cross-section; means being provided at or adjacent one end thereof to allow for said winch handle to be releasably engaged with a winch; means being provided at the other end of said body portion in the form of, or to be attached or connected to, grip means; reinforcing means being provided within said body portion; and further including an elongate cover portion of a substantially open-faced inverted "U" configuration when viewed in cross-section; reinforcing means being provided within said cover portion; outer sides of said body portion and said cover portion being formed so as to allow for a substantially open-face to open-face engagement between said body portion and said cover portion; and wherein said body portion and said cover portion are so sealably engaged one with the other, so as to form an integral reinforced winch handle.

BRIEF DESCRIPTION OF THE ACCOMPANYING DRAWINGS

This invention will now be described by way of example only and with reference to the accompanying drawings, wherein:

FIG. 1 is a perspective view of a winch handle according to one form of the present invention, FIG. 2 is an exploded longitudinal side view of a winch handle according to one form of the present invention and as generally shown in FIG. 1 of the drawings, and FIG. 3 is a cross-sectional view of exploded portions of the winch handle along lines 3—3 as generally shown in FIG. 2 of the accompanying drawings.

DETAILED DESCRIPTION OF PREFERRED EMBODIMENTS

The invention will now be described by way of example only with reference to the accompanying drawings. While the invention has particular application to handles and winch handles for use with marine craft, it should be appreciated that the winch handle of the present invention can be used in other situations and in connection with other winches and the like. The invention is not intended to be limited to use with marine craft or marine winches.

Figure 1:
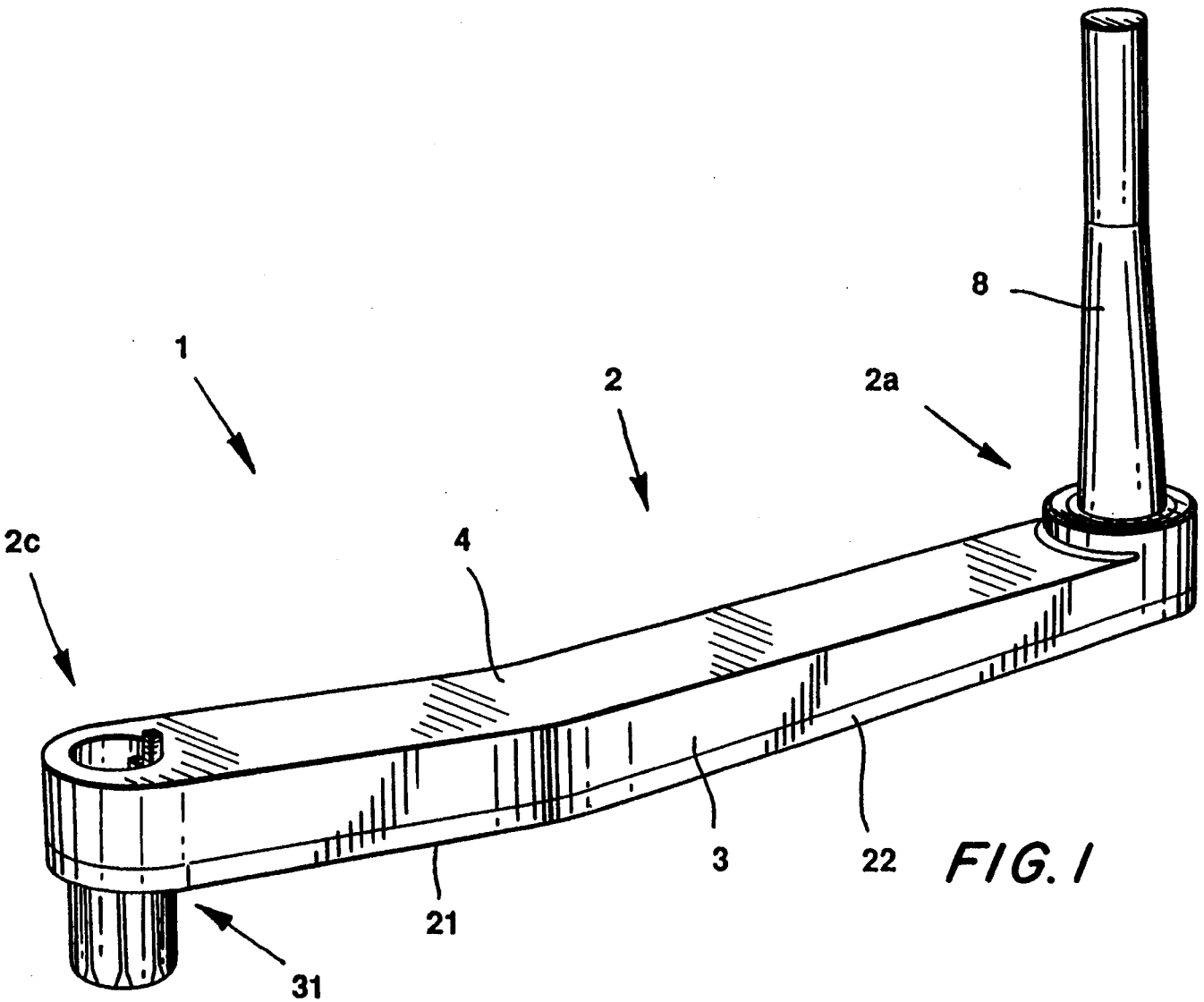
Figure 2:
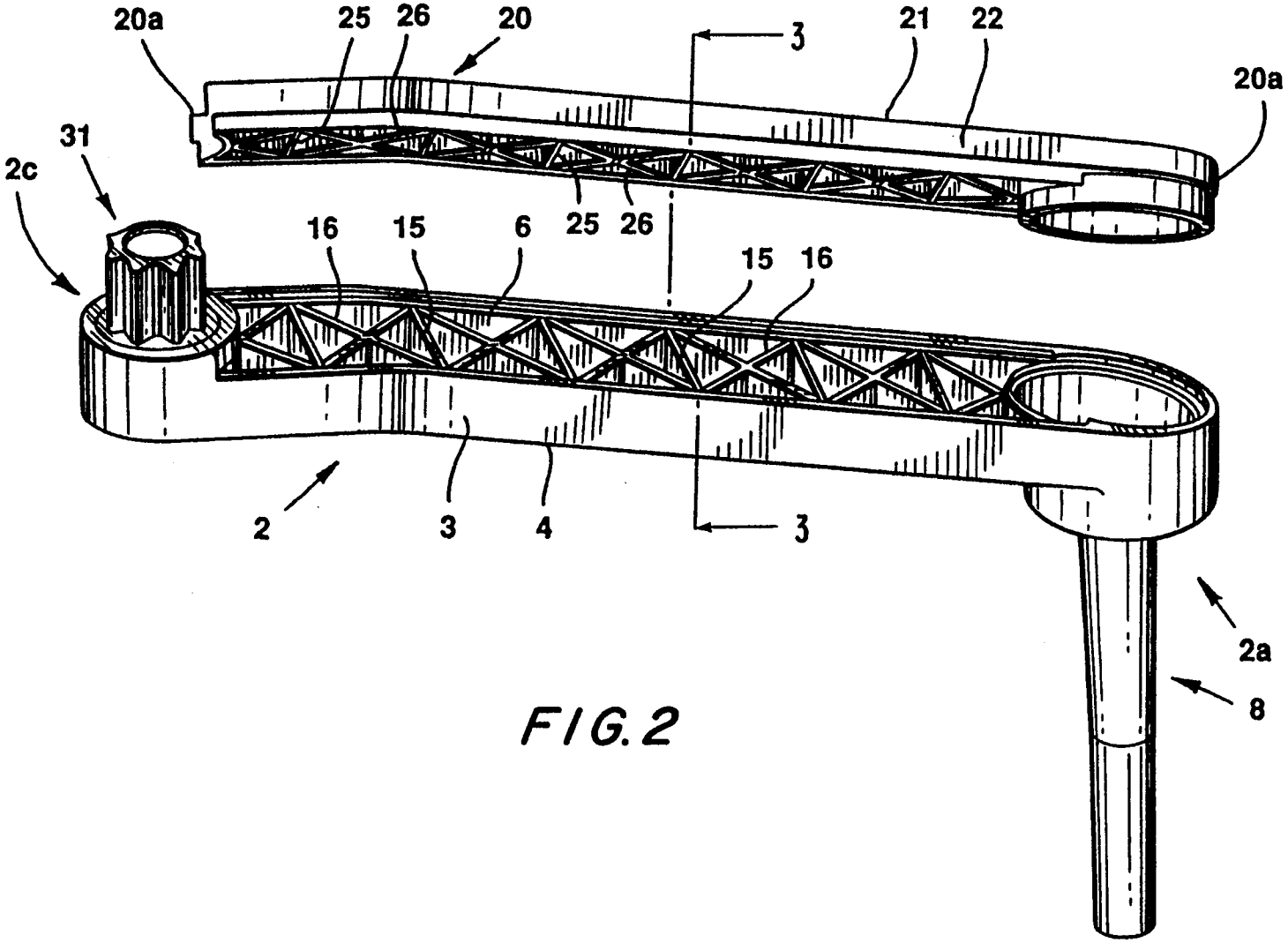

In referring to the accompanying drawings, it should be appreciated that for ease of explanation, FIG. 2 of the drawings shows an exploded winch handle showing exploded portions of the winch handle, in a substantially inverted position relative to the normal orientation of a winch handle (as for example shown in FIG. 1 of the accompanying drawings). The illustration of the winch handle in FIG. 2 of the accompanying drawings is however for ease of description and it should be appreciated that in normal use, a winch handle will normally be used in the general orientation shown, by way of example only, in FIG. 1 of the drawings.

The winch handle 1 of the present invention is preferably formed of a plastics material, such as for example a nylon plastics material, which is suitably reinforced, such as with fibreglass or the like, for strength and rigidity. Other reinforced plastics materials can however be used. It should be appreciated however that the winch handle can be provided and formed of other appropriate synthetic, plastics or light-weight materials.

The winch handle 1 includes a substantially elongate recessed body portion 2 being of a substantially inverted "U" formation when viewed in cross-section so as to form a recessed elongate body portion 2. The body portion 2 has an open-face 6 with outwardly extending sides 3 and a base 4. As will be appreciated however, in its normal orientation for use, the base 4 becomes the upper face surface of the winch handle when the winch handle is in the general orientation shown by way of example in FIG. 1 of the drawings.

The body portion 2 is preferably integrally formed or molded as an integral unitary formation and as referred to above, the open-face 6 of the body portion 2 will normally form the underside thereof, while the outer surface of the base 4 will form the upper surface of the winch handle.

In one preferred form of the invention the body portion 2 is substantially curvilinear. This is however by way of example only.

At one end 2*a* of the body portion 2, a grip means 8 is provided for gripping or holding by a user or operator. The grip means 8 includes an upstanding grip mounting about which may be located a grip housing. Other grips or handles can however be provided.

At the other end 2*c* of the body portion 2, means are provided for the winch handle to be releasably engaged with a winch (not shown) for operation thereof. In preferred forms of the invention the engagement means is in the form of a spigot member 31, such as for example a tooth spigot which is adapted to releasably engage with a winch to allow for operation thereof. Appropriate locking and release means can be provided in association therewith to allow for the releasable locking and release of the spigot 31 relative to a winch (not shown). In one form of the invention the spigot 31 is formed or cast of an aluminium or metal material, but this is by way of example only, and other materials can be used.

The recessed body portion 2 of the winch handle 1 is formed or provided with reinforcing therein, in the form of integrally formed or moulded webs, being transverse webs 15 and angled webs 16. These webs 15, 16 are integrally formed within the recess of the body portion 2 and extend between sides thereof, to impart strength and rigidity to the winch handle and so as to minimise or overcome any problems associated with the twisting of the winch handle when torque is applied thereto. In a preferred form of the invention as shown in the accompanying drawings, the transverse reinforcing webs 15 are longitudinally spaced apart with angled web 16 (of a generally "X" configuration) extending therebetween.

The reinforcing webs 15, 16 are of such a height and extend upwardly from within the recess of the body portion 2 to such an extent as to be spaced apart from and below outer side ends 3*a* of the sides 3 of the body portion 2.

Preferably, the upper side ends 3*a* of the sides 3 are stepped or profiled so as to allow for engagement with a cover means or cover portion 20, as will be described hereinafter.

The handle of the present invention further includes a cover portion 20 which is elongate in formation and of a width and length such as to engage with and over the open upper face 6 of the body portion 2. This will be described hereinafter.

Figure 3:
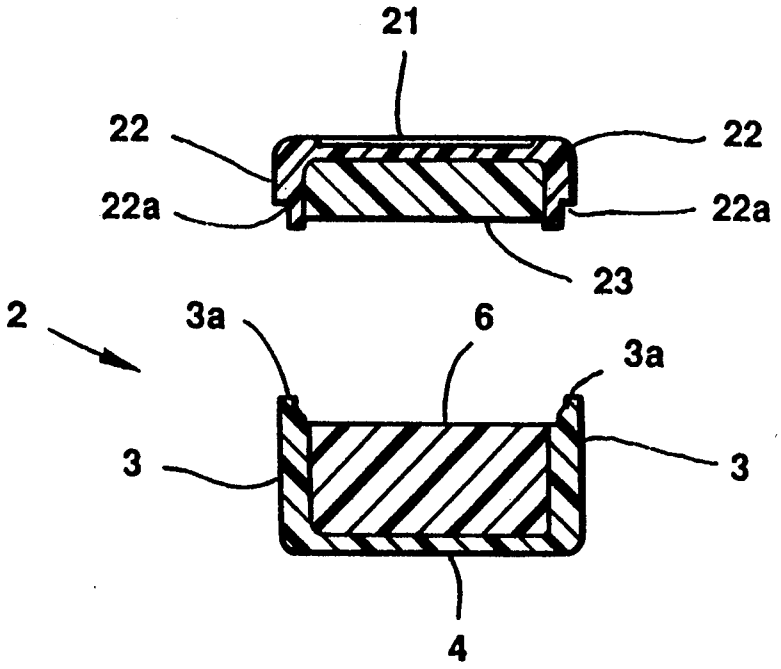

The elongate cover portion 20 is formed with a base 21 and outwardly extending side arms 22, so as to define an elongate open-faced cover portion of a generally open-faced inverted "U" configuration when viewed in cross-section (in FIGS. 2 and 3 of the drawings).

While the base 21 is so described, (with reference to FIG. 1) it will be appreciated that in the exploded forms of the winch handle shown in FIGS. 2 and 3 of the accompanying drawings, the base 21 is in fact the upper surface 21. As will be appreciated however from FIG. 1 of the accompanying drawings, in the normal orientation of the winch handle 1, the surface 21 is the base surface 21.

Outer ends 22*a* of the sides 22 of the cover portion 20 are so stepped or profiled as to engage with stepped outer side ends 3*a* of the sides 3 of the body portion 2.

Within the recessed cover portion 20, reinforcing means are provided in the form of transverse reinforcing webs 25 and angled reinforcing webs 26. The reinforcing webs 25, 26 are preferably located and so orientated, such as to correspond substantially to the location and orientation of transverse and angled webs 15, 16 in the body portion 2. This will be described further hereinafter.

The reinforcing webs 25, 26 of the cover portion 20 extend outwardly from within the recessed cover portion 20, so as to be spaced apart from and below the outer side ends 22*a* of the sides 22. Ends 20*a* and 20*b* of the cover portion 20 are so formed and profiled as to releasably engage with and about profiled portions of the body portion 2, so that the cover portion 20 can be securely engage with and over the body portion 2, such that the reinforcing webs 15, 16 of the body portion and 25, 26 of the cover portion align substantially one with the other and so that the profiled or stepped ends 3*a* of the sides 3 and 22*a* of the sides 22 of the body portion and cover portion respectively can engage one with the other. In one preferred form of the invention, the outer side ends 3*a* and 22*a* of the body portion and cover are so profiled and dimensioned as to allow for a secure fitting engagement therebetween.

On such engagement, the cover portion and body portion are securely engaged and sealed one with the other such as by bonding, ultrasonic welding, heat-welding or the like. Other securing and/or sealing means can be used. This then seals the body portion 2 and cover portion 20 relative to each other to form an integral elongate 'post like' handle which has substantially enhanced features of strength and rigidity, especially when torque is applied thereto, given the fact that substantial reinforcing webs are provided right through the recessed body portion and recessed cover portion which are sealably engaged one with the other. Given the sealable engagement, the cover portion and body portion are unable to be taken apart, and thus there are inherent features of strength and rigidity within the handle 1, especially when twisting action is applied thereto, such as on the winch being used.

In one form of the invention the sealed winch handle 1 forms a sealed flotation or buoyancy chamber so that the handle 1 is preferably a floating winch handle. This is not however essential to the performance of the invention in that the invention provides for substantially improved features of strength and rigidity brought about by the construction of the handle and the provision of the reinforcing webs within both the recessed body portion and recessed cover portion, which are sealably engaged one with the other. If however the winch handle is to be used as a floatable winch handle, then to enhance features of flotation and buoyancy, a foam 60 (such as foam plastic) or the like can be added into the recessed body portion 2 and/or recessed cover portion 20, so as to enter into those areas between the reinforcing webs 15 and 16. It is also envisaged that appropriate foam to enhance features of flotation and buoyancy can be inserted into the handle mounting means 8 or handle associated therewith.

The present invention provides a straightforward and efficient winch handle which has enhanced features of strength and rigidity and which overcomes or minimises at least some problems associated with winch handles known and used up until this time.

This invention has been described by way of example only and it should be appreciated that modifications and improvements may be made to the invention without departing from the scope thereof, as defined by the appended claims.

I claim:

1. A handle including an elongate recessed body portion of an open-faced "U" configuration when viewed in transverse cross-section; reinforcing webs being provided within the said body portion; there being further provided an elongate recessed cover portion of an open-faced inverted "U" configuration when viewed in transverse cross-section; reinforcing webs being provided within said cover portion; said reinforcing webs of the body portion and cover portion extending between inner side surfaces thereof, but being spaced apart from and below upper side edges thereof; the arrangement being such that when said body portion and said cover portion are located and positioned open-face to open-face, respective reinforcing webs of said body portion and said over portion align and correspond one to the other, said body portion and said cover portion being sealably engaged one with the other.

2. A handle as claimed in claim 1, wherein engaging means are provided adjacent one end of said handle to allow for said opposite handle to be releasably engaged with a winch; grip means being provided at the opposite end of said handle.

3. A handle as claimed in claim 1, wherein said reinforcing webs include transverse and angled reinforcing webs extending between inner side surfaces of said recessed body portion and said recessed cover portion.

4. A handle as claimed in claim 1, wherein said reinforcing web in said recessed body portion and said recessed cover portion are in the form of an alternate transverse and angled reinforcing webs, extending between inner side surfaces of said recessed body portion and said recessed cover portion.

5. A handle as claimed in claim 1, wherein said reinforcing webs include angled reinforcing webs within said recessed cover portion, of a substantially "X" configuration.

6. A handle as claimed in claim 1, wherein upper side edges of said recessed body portion and said recessed cover portion are profiled as to allow for engagement therebetween.

7. A handle as claimed in claim 1, wherein foamed plastics material is provided within said recessed body portion so as to enhance buoyancy of said handle.

8. A handle as claimed in claim 1, wherein foamed plastics material is provided within said recessed cover portion.

9. A handle as claimed in claim 1, formed of a reinforced plastics material.

* * * * *